US006967449B2

(12) United States Patent
Ishihara et al.

(10) Patent No.: US 6,967,449 B2
(45) Date of Patent: Nov. 22, 2005

(54) DISCHARGE LAMP LIGHTING APPARATUS

(75) Inventors: Yutaka Ishihara, Tokyo (JP); Akiko Takeya, Tokyo (JP); Masayuki Yamashima, Tokyo (JP)

(73) Assignee: TDK Corporation, Tokyo (JP)

( * ) Notice: Subject to any disclaimer, the term of this patent is extended or adjusted under 35 U.S.C. 154(b) by 28 days.

(21) Appl. No.: 10/807,232

(22) Filed: Mar. 24, 2004

(65) Prior Publication Data

US 2004/0189217 A1 Sep. 30, 2004

(30) Foreign Application Priority Data

Mar. 25, 2003 (JP) ..... 2003-083308

(51) Int. Cl.[7] ..... H05B 37/02

(52) U.S. Cl. ..... 315/307; 315/224; 315/308

(58) Field of Search ..... 315/307, 308, 315/224, DIG. 5

(56) References Cited

U.S. PATENT DOCUMENTS 5,142,203 A * 8/1992 Oda et al. ..... 315/308
5,465,029 A * 11/1995 Hanazaki et al. ..... 315/308

FOREIGN PATENT DOCUMENTS

JP 3-116693 5/1991

* cited by examiner

*Primary Examiner*—David Vu
(74) *Attorney, Agent, or Firm*—Oblon, Spivak, McClelland, Maier & Neustadt, P.C.

(57) ABSTRACT

The present invention relates to a discharge lamp lighting apparatus in which overshoot occurring when the polarity of AC rectangular wave voltage/current is inverted is suppressed. An inverter converts DC power supplied by a converter to AC rectangular wave power and outputs the AC rectangular wave power. A power calculation unit generates a power detection signal based upon a voltage detection signal and a current detection signal detected on the output side of the converter. A control target value setting unit outputs an output power command value to be used to control the DC power so as to achieve a target value. A correction signal generation unit outputs a correction signal to be used to correct the output power command value in conformance to the power detection signal in synchronization with a polarity inversion of the AC rectangular wave power. A converter control signal generation unit outputs a signal corresponding to the error of the power detection signal relative to the output power command value. A pulse width control unit implements pulse width control on the converter based upon the signal provided by the converter control signal generation unit.

12 Claims, 11 Drawing Sheets

PRIOR ART

PRIOR ART

DISCHARGE LAMP LIGHTING APPARATUS

BACKGROUND OF THE INVENTION

1. Field of the Invention

The present invention relates to a discharge lamp lighting apparatus that converts DC power to AC rectangular wave power and supplies the AC rectangular wave power to a discharge lamp. More specifically, the present invention relates to a discharge lamp lighting apparatus that can be utilized in an ideal manner to light a high-pressure discharge lamp such as a high-pressure mercury lamp or an ultra high-pressure mercury lamp with AC rectangular wave power.

2. Discussion of Background

It is known in the related art that a high-pressure discharge lamp can be lit with a relatively high degree of efficiency by supplying AC rectangular wave power with a low frequency of, for instance, approximately 50 to 500 Hz.

A discharge lamp lighting apparatus that lights a discharge lamp with AC rectangular wave power normally rectifies a commercial alternating current to convert it to direct current, and executes power control on the direct current by using a converter constituted with a step-down chopper circuit, and converts the power to a low-frequency AC rectangular wave current/voltage through an inverter constituted of a bridge circuit achieved by combining two or four semiconductor switch elements, and supplies the AC rectangular wave current/voltage to the discharge lamp.

JP Patent Publication No. 1991-116693A discloses a discharge lamp lighting apparatus that lights a discharge lamp with such AC rectangular wave power. The discharge lamp lighting apparatus disclosed in this patent publication includes a chopper circuit connected to a DC source, which operates with a high frequency, a bridge inverter circuit that is connected to the chopper circuit and is constituted of a switch element which operates at a low frequency and a load circuit that includes a discharge lamp connected to the output side of the bridge inverter circuit via a pulse transformer.

The pulse transformer is constituted as a closed magnetic circuit in order to minimize the magnetic flux leak. However, a pulse transformer constituted as a closed magnetic circuit poses a problem in that when the rectangular wave current flowing through the serial circuit constituted with the discharge lamp and the primary winding of the pulse transformer is inverted, the magnetic energy generated at the core of the pulse transformer changes drastically to induce a beat at the area where the core is joined.

Accordingly, the discharge lamp lighting apparatus disclosed in this patent publication implements control so as to reduce the current supplied by the chopper circuit in synchronization with the timing with which the switch element at the bridge inverter circuit is turned on/off in order to minimize the beat occurring at the pulse transformer.

However, there is another issue that must be addressed in addition to the occurrence of buzz in a discharge lamp lighting apparatus that lights a discharge lamp with AC rectangular wave power. Namely, a vibration attributable to the impedance characteristics of the circuit of the discharge lamp lighting apparatus and the impedance characteristics of the lamp itself may occur when the AC rectangular wave voltage/current is inverted to result in an occurrence of an overshoot. Such an occurrence of an overshoot leads to various problems with regard to the discharge lamp.

The following is an explanation of a state in which an overshoot occurs, given in reference to the drawings. FIG. 13 shows the waveforms of the output voltage from the converter, the output current from the inverter and bridge signals at the inverter, detected in the discharge lamp lighting apparatus which lights a discharge lamp with AC rectangular wave power. FIG. 14 shows a partial enlargement of the waveform diagram in FIG. 13. The output voltage/current from the converter, which is a controlled DC voltage/current, is converted to an AC rectangular wave voltage/current at the bridge inverter connected at a rear stage of the converter.

For this reason, while the output voltage from the converter and the output current from the inverter are individually controlled to sustain the voltage level and the current level needed by the lamp load until immediately before polarity inversion time points at which the ON/OFF states of the bridge signals 1 and 2 are switched over, vibration manifests as the polarity inversion occurs, as shown in FIG. 13.

To explain this point in further detail, an inverter is normally constituted of a bridge circuit by using semiconductor switch elements. In order to prevent shorting, the semiconductor switch elements in the bridge circuit are not allowed to enter an ON state simultaneously by implementing ON/OFF control on the semiconductor switch elements with dead time allowed to elapse at the time of a polarity inversion.

As shown in FIG. 14, the semiconductor switch elements are all set in an OFF state during the dead time period td, and thus, the energy communicated from the converter cannot reach the load, i.e., the lamp, thereby inducing a rise in the output voltage from the converter. In addition, the inductance component present in the circuit of the discharge lamp lighting apparatus induces a commutation of the current and the current flows from the discharge lamp to the converter, thereby causing a rise in the output voltage from the converter.

Following the dead time period td, the semiconductor switch element in the bridge circuit enters an ON state to allow the output voltage from the converter to be applied to the discharge lamp. Since the output voltage from the converter at this time is higher, the voltage/current supplied to the discharge lamp achieve larger values compared to the voltage/current values before the inversion, thereby causing vibration and overshoot.

The levels of the current/voltage being supplied to the lamp when such an overshoot occurs are excessively high for the discharge lamp. The electrode at the discharge lamp becomes damaged every time the state of excess current/voltage occurs as the polarity of the AC rectangular wave voltage/current is inverted, and with the electrode damaged in this manner constantly over time, the service life of the discharge lamp is reduced.

The extent of overshoot may be reduced by increasing the capacity of the output capacitor in the converter. In such a case, while the extent of increase in the output voltage from the converter can be minimized, the vibration cycle is lengthened to result in an increase in the length of time to elapse before the vibration becomes settled. If there is any residual vibration in the voltage/current supplied to the discharge lamp, problems arise in that the vibration in the light output from the discharge lamp manifests as flickering, in that the discharge lamp fails to startup fully or in that there is an increase in the rush current (shorting current) flowing to the discharge lamp as the AC rectangular wave voltage/current becomes inverted.

It is believed that a rise in the rush current (shorting current) flowing to the discharge lamp when the polarity of the AC rectangular wave voltage/current is inverted causes wear in the electrode of the discharge lamp, which will result in a reduced service life of the discharge lamp.

For this reason, it is necessary to ensure that the discharge lamp is lit in a desirable manner by adjusting the waveform of the voltage/current supplied to the discharge lamp when the polarity of the AC rectangular wave voltage/current becomes inverted and thus minimizing the extent of overshoot.

In addition, since the overshoot manifests to a great extent when the level of the current supplied to the discharge lamp is high, manifests to a small extent when the level of the current supplied to the discharge lamp is low and also manifests to fluctuating extent depending upon the accumulated lengths of time over which individual discharge lamps have been in an ON state, a discharge lamp lighting apparatus that allows the extent to which overshoot is reduced to be controlled is needed.

SUMMARY OF THE INVENTION

It is an object of the present invention to provide a discharge lamp lighting apparatus that assures a longer service life for a discharge lamp by reducing the extent of overshoot of an AC rectangular wave voltage/current occurring when the polarity of the AC rectangular wave voltage/current is inverted.

It is a further object of the present invention to provide a discharge lamp lighting apparatus that prevents flickering of a discharge lamp and also prevents the discharge lamp from failing to startup fully by suppressing vibration of the voltage/current when the polarity of the AC rectangular wave voltage/current is inverted.

It is a still further object of the present invention to provide a discharge lamp lighting apparatus capable of lighting a discharge lamp in a stable manner regardless of the accumulated length of time over which the particular discharge lamp has been on by controlling the extent to which overshoot of the voltage/current is suppressed when the polarity of the AC rectangular wave voltage/current is inverted.

In order to achieve the objects described above, the discharge lamp lighting apparatus according to the present invention comprises a converter, an inverter and a controller.

The converter switches power input thereto, converts the switching output to DC power and outputs the DC power.

The inverter converts the DC power supplied from the converter to AC rectangular wave power and outputs the AC rectangular wave power.

The controller comprises a power calculation unit, a control target value setting unit, a correction signal generation unit, a converter control signal generation unit and a pulse width control unit.

The power calculation unit generates a power detection signal by calculating the power based upon a voltage detection signal and a current detection signal detected on the output side of the converter.

The control target value setting unit outputs an output power command value to be used to control the DC power so as to achieve a target value.

The correction signal generation unit generates a correction signal to be used to correct the output power command value in conformance to the power detection signal and outputs the correction signal in synchronization with a polarity inversion of the AC rectangular wave power.

The converter control signal generation unit receives the output power command value, the correction signal and the power detection signal and outputs a signal corresponding to the error of the power detection signal relative to the output power command value having been corrected by the correction signal.

The pulse width control unit implements pulse width control on the converter based upon the signal provided by the converter control signal generation unit.

In the discharge lamp lighting apparatus according to the present invention described above, the converter switches power input thereto, converts the switching output to DC power and outputs the DC power, and then the inverter converts the DC power supplied from the converter to AC rectangular wave power and outputs the AC rectangular wave power. Thus, the discharge lamp is driven with the AC rectangular wave power.

The power calculation unit generates a power detection signal by calculating the power based upon the voltage detection signal and the current detection signal detected on the output side of the converter. The control target value setting unit outputs an output power command value to be used to control the DC power so as to achieve a target value. The correction signal generation unit generates a correction signal to be used to correct the output power command value in conformance to the power detection signal and outputs the correction signal in synchronization with a polarity inversion of the AC rectangular wave power. The converter control signal generation unit receives the output power command value, the correction signal and the power detection signal and outputs a signal corresponding to the error of the power detection signal relative to the output power command value. The pulse width control unit implements pulse width control on the converter based upon the signal provided by the converter control signal generation unit.

As a result, the converter output is controlled so as to achieve the level of power required by the discharge lamp, and also, control is implemented so that the converter output is corrected by using the correction signal when a polarity inversion occurs in the AC rectangular wave power. Thus, it is possible to reduce the extent of overshoot and vibration in the voltage/current occurring when the polarity of the AC rectangular wave voltage/current is inverted and also to control the extent to which the overshoot and vibration are reduced, thereby minimizing damage to the electrode of the discharge lamp and lengthening the service life of the discharge lamp.

In addition, a discharge lamp lighting apparatus capable of lighting a discharge lamp in a stable manner regardless of the accumulated length of time over which the particular discharge lamp has been in an ON state without allowing the discharge lamp to flicker or fail to fully start up is provided.

While the discharge lamp lighting apparatus according to the present invention may be adopted to implement any of; voltage control, current control and power control, the current control can be implemented in an ideal manner to light a discharge lamp by assigning the value of the current of the DC power as the control target value.

At least the power calculation unit and the correction signal generation unit in the controller may be constituted with a microcomputer. By constituting these components with a microcomputer, various control modes such as time control implemented to control the length of time over which the correction signal is generated, level control implemented to control the level of the correction signal and pattern control implemented to select a specific pattern among various correction signal patterns stored in memory of the microcomputer, as well as correction quantity zero control under which the overshoot is not suppressed at all, can be achieved with ease.

BRIEF DESCRIPTION OF THE DRAWINGS

Further objects and advantages of the invention can be more fully understood from the following detailed description taken in conjunction with the accompanying drawings, in which.

DETAILED DESCRIPTION OF THE PREFERRED EMBODIMENT

Figure 1:
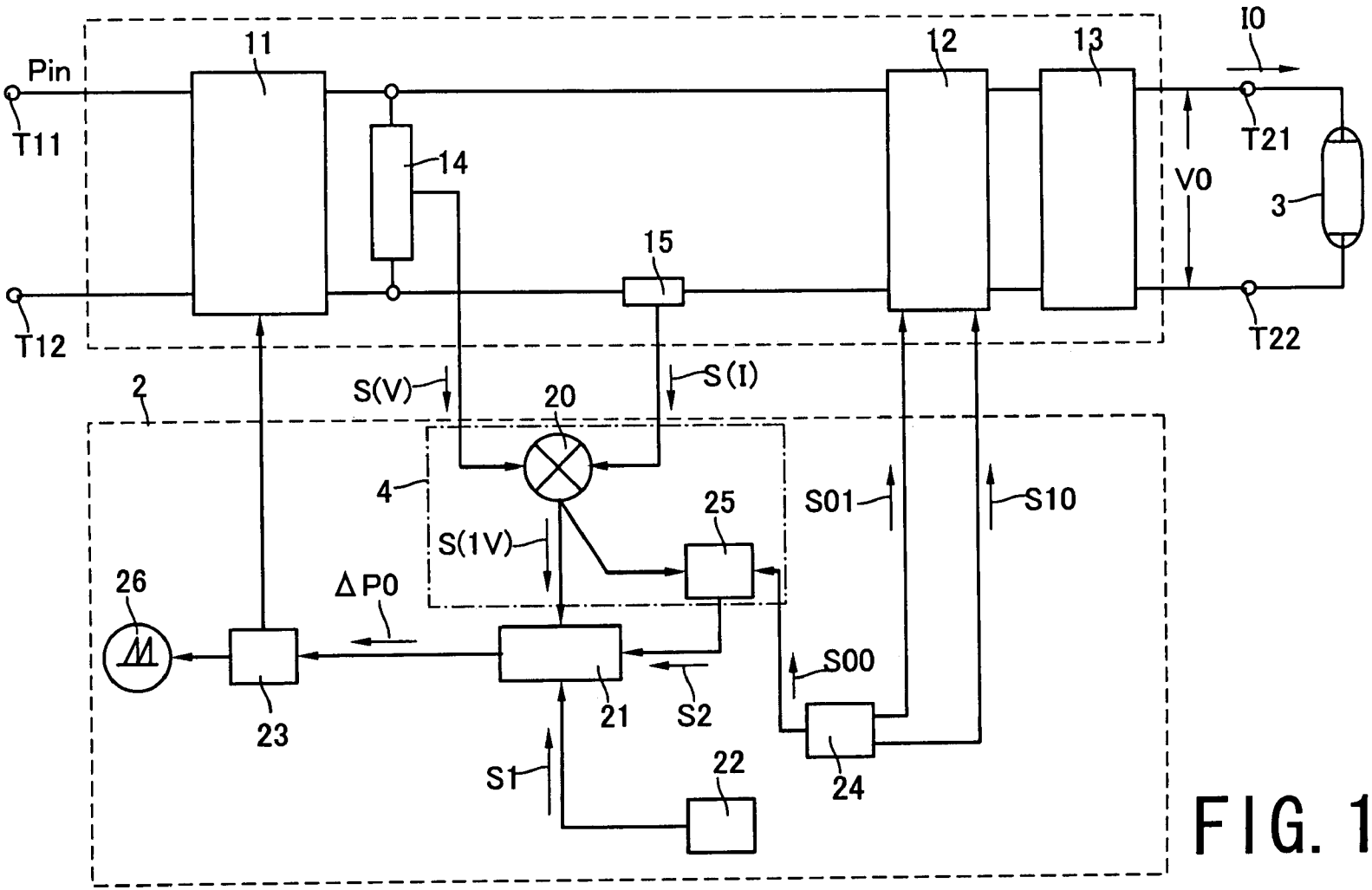
FIG. 1 is a block diagram of an embodiment of the discharge lamp lighting apparatus according to the present invention.

FIG. 1 is a block diagram of an embodiment of the discharge lamp lighting apparatus according to the present invention. The discharge lamp lighting apparatus in the figure includes a converter 11, an inverter 12, a high voltage generation unit 13 and a controller 2.

The converter 11 switches input DC power Pin supplied to its input terminals T11 and T12, converts the switching output to DC power and outputs the DC power. The switching frequency at the converter 11 may be set to, for instance, a value within a range of 10 to 500 KHz.

The inverter 12 converts the DC power supplied from the converter 11 to AC power and outputs the AC power. The inverter 12, which is a type of rectangular wave generating circuit, is constituted as a bridge circuit or the like by combining two or four semiconductor switch elements and outputs AC rectangular wave power. The inverter 12 is driven by drive pulse signals S10 and S01 supplied from an inverter drive circuit 24. The drive pulse signal S10, which is obtained by inverting the drive pulse signal S01, shifts to low level (logic value 0) when the drive pulse signal S01 is set to high level (logic value 1) and shifts to high level (logic value 1) when the drive pulse signal S01 is set to low level (logic value 0). In addition, the drive pulse signal S01 and S10 are both sustained at high level over a period of time so as to create a dead time during which all the semiconductor switch elements are set in an OFF state as the drive pulse signals S01 and S10 are switched. Alternatively, the drive pulse signals S01 and S10 may both be sustained at low level instead of high level over a period of time when they are switched.

The switching frequency of the inverter 12, which is determined in conformance to the drive pulse signals S10 and S01, is set to a value lower than the switching frequency of the converter 11. For instance, a value within a range of 10 to 500 KHz may be selected for the switching frequency at the converter 11, whereas a value within a range of 50 to 500 Hz may be selected for the switching frequency at the inverter 12.

The discharge lamp lighting apparatus in the embodiment further includes the high-voltage generation unit 13 provided at a stage rearward relative to the inverter 12. The high voltage generation unit 13 generates the high voltage needed to start up a discharge lamp 3 and supplies this high voltage to output terminals T21 and T22.

The two ends of the discharge lamp 3 are each connected to one of the output terminals T21 and T22 so that it receives a high voltage startup pulse from the high voltage generation unit 13 via the output terminals T21 and T22 when it is turned on, whereas it receives the AC rectangular wave power supplied by the inverter 12 in the steady state.

The controller 2 includes a power calculation unit 20, a converter control signal generation unit 21, a control target value setting unit 22, a pulse width control unit 23, the inverter drive circuit 24 and a correction signal generation unit 25. The power calculation unit 20 generates a power detection signal S(IV) by calculating the power based upon a voltage detection signal S(V) and a current detection signal S(I).

The voltage detection signal S(V) is obtained by a voltage detection circuit 14 which detects the voltage manifesting on the output side of the converter 11. While the voltage, output by the converter 11 is DC voltage, it also contains a voltage information corresponding to an AC pulse voltage Vo supplied to the discharge lamp 3. For this reason, the voltage detection signal S(V) can be used as information related to the AC pulse voltage Vo.

The current detection signal S(I) is obtained by a current detection circuit 15 which detects the current flowing through a power supply line. The current flowing through the power supply line is substantially equal to an AC pulse current Io flowing to the discharge lamp 3. Accordingly, the current detection signal S(I) can be used as information related to the AC pulse current Io.

The control target value setting unit 22 outputs an output power command value S1 to be used to control the DC power output by the converter 11 so that the DC power achieves a target value suitable for power supply to the discharge lamp 3.

The correction signal generation unit 25 receives the power detection signal S(IV) from the power calculation unit 20 and, in addition, receives a polarity inversion signal S00, which is synchronous with the drive pulse signals S10 and S01, from the inverter drive circuit 24. The correction signal generation unit 25 then generates a correction signal S2 to be used to reduce the output power command value S1 in conformance to the power detection signal S(IV) and outputs the correction signal S2 in synchronization with the polarity inversion of the AC rectangular wave power output by the inverter 12.

The converter control signal generation unit 21 receives the output power command value S1 from the control target value setting unit 22, receives the correction signal S2, which is used to correct the output power command value S1, from the correction signal generation unit 25, and receives the power detection signal S(IV) from the power calculation unit 20. The converter control signal generation unit 21 then outputs a signal ΔPo corresponding to the error of the power detection signal S(IV) relative to the output power command value S1 having been corrected by the correction signal S2.

The pulse width control unit 23 implements pulse width control on the converter 11 based upon the signal ΔPo provided by the converter control signal generation unit 21. In more specific terms, the pulse width control unit 23 has a triangular wave oscillation circuit 26, generates a signal with a pulse width corresponding to the signal ΔPo by using a triangular wave signal provided by the triangular wave oscillation circuit 26 and the signal ΔPo provided by the converter control signal generation unit 21 and supplies the signal thus generated to the converter 11 to control the switching operation at the converter 11.

When the converter 11 is engaged in the switching operation under the pulse width control described above, the voltage and current manifesting on the output side of the converter 11 are detected by the voltage detection unit 14 and the current detection unit 15 respectively. Then, the voltage detection signal S(V) and the current detection signal S(I) are provided to the power calculation unit 20 which, in turn, provides the power detection signal S(IV) to the converter control signal generation unit 21. The power detection signal S(IV) is compared with the output power command value S1 at the signal generation unit 21 which then generates the signal ΔPo corresponding the error of the power detection signal relative to the output power command value S1. The pulse width control unit 23, in turn, implements pulse width control on the converter 11 based upon the signal ΔPo.

In this structure, the correction signal generating unit 25 generates the correction signal S2 to be used to reduce the output power command value S1 in conformance to the power detection signal (IV) and outputs the correction signal S2 in synchronization with a polarity inversion of the AC rectangular wave power. Thus, the reduced output power command value S1 is compared with the power detection signal S(IV) to result in the pulse width control implemented to reduce the power output from the converter 11 when the polarity of the AC rectangular wave power is inverted. As a result, the extent of overshoot and vibration in the voltage/current is suppressed when the polarity of the AC rectangular wave voltage/current is inverted.

In addition, the correction signal generation unit 25 generates the correction signal S2 to reduce the output power command value S1 in conformance to the power detection signal S(IV), and consequently, the extent to which overshoot and vibration are suppressed can be controlled in a desirable manner.

Among the components constituting the controller 2, the power calculation unit 20, the correction signal generation unit 25 and the drive signal generating portion of the inverter drive circuit 24 are constituted with a microcomputer 4. By employing the microcomputer 4 in this manner, the structure of the control unit 2 can be simplified and, at the same time, highly advanced control can be achieved.

The following is an explanation of various control modes achieved in the embodiment, given on the assumption that the control unit 2 includes the microcomputer 4 and in reference to flowcharts and timing charts.

Figure 2:
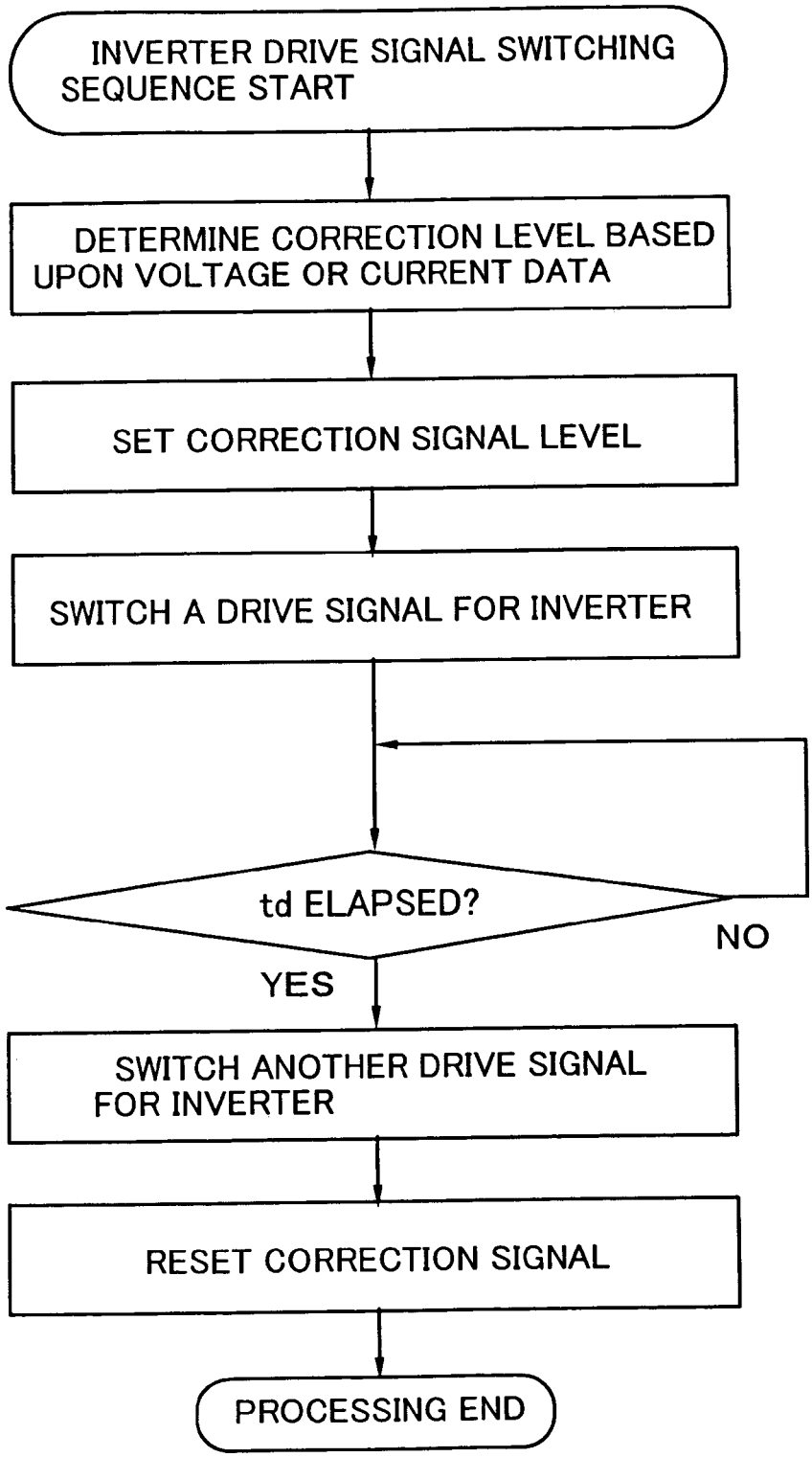
FIG. 2 presents a flowchart of the first control mode achieved in the embodiment shown in FIG. 1.
Figure 3:
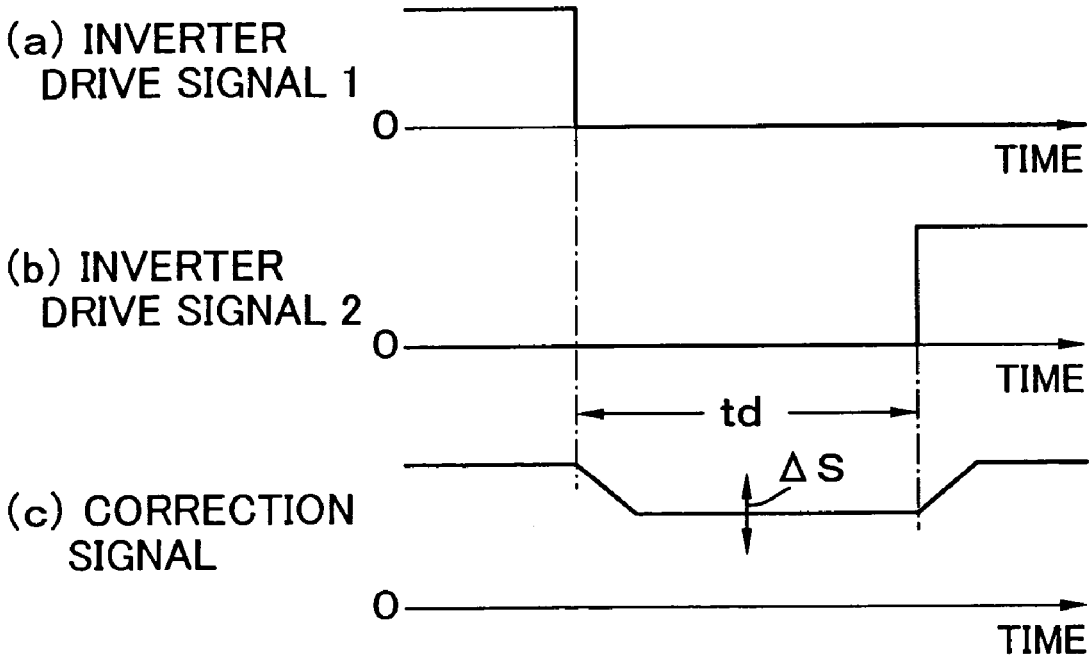
FIG. 3 is a timing chart of the first control mode achieved in the embodiment shown in FIG. 1.

FIG. 2 presents a flowchart of a first control mode achieved in the embodiment of the discharge lamp lighting apparatus according to the present invention and FIG. 3 is a timing chart of the first control mode. In FIG. 3, td represents the dead time created for the switch elements constituting the inverter 12 and an arrow ΔS represents the extent to which the correction signal S2 can be varied.

In this control mode, control is implemented by varying the level of the control signal as indicated by the arrow ΔS in the figure. The sequence of the control mode starts, then the correction level is determined based upon the power detection signal S(IV) provided by the power calculation unit 20, and the correction signal is set accordingly.

Next, the drive signal 1 for the inverter 12 is switched and, in response, the inverter 12 enters the dead time period td. The length of the dead time td is set in advance to a predetermined length of time.

When the dead time period td elapses, the drive signal 2 for the inverter 12 is switched, thereby inverting the polarity of the AC rectangular wave output from the inverter 12. Subsequently, the correction signal is reset, and the sequence of the processing ends.

During this sequence, the correction signal generation unit 25 provides the correction signal S2 to the converter control signal generation unit 21 so as to reduce the output power command value S1. As a result, the extent of overshoot and vibration in the voltage/current is reduced when the polarity of the AC rectangular wave voltage/current is inverted. In addition, since the level of the correction signal S2 is controlled in conformance to the power detection signal S(IV), the extent to which the overshoot and vibration is suppressed are controlled in a desirable manner.

Figure 4:
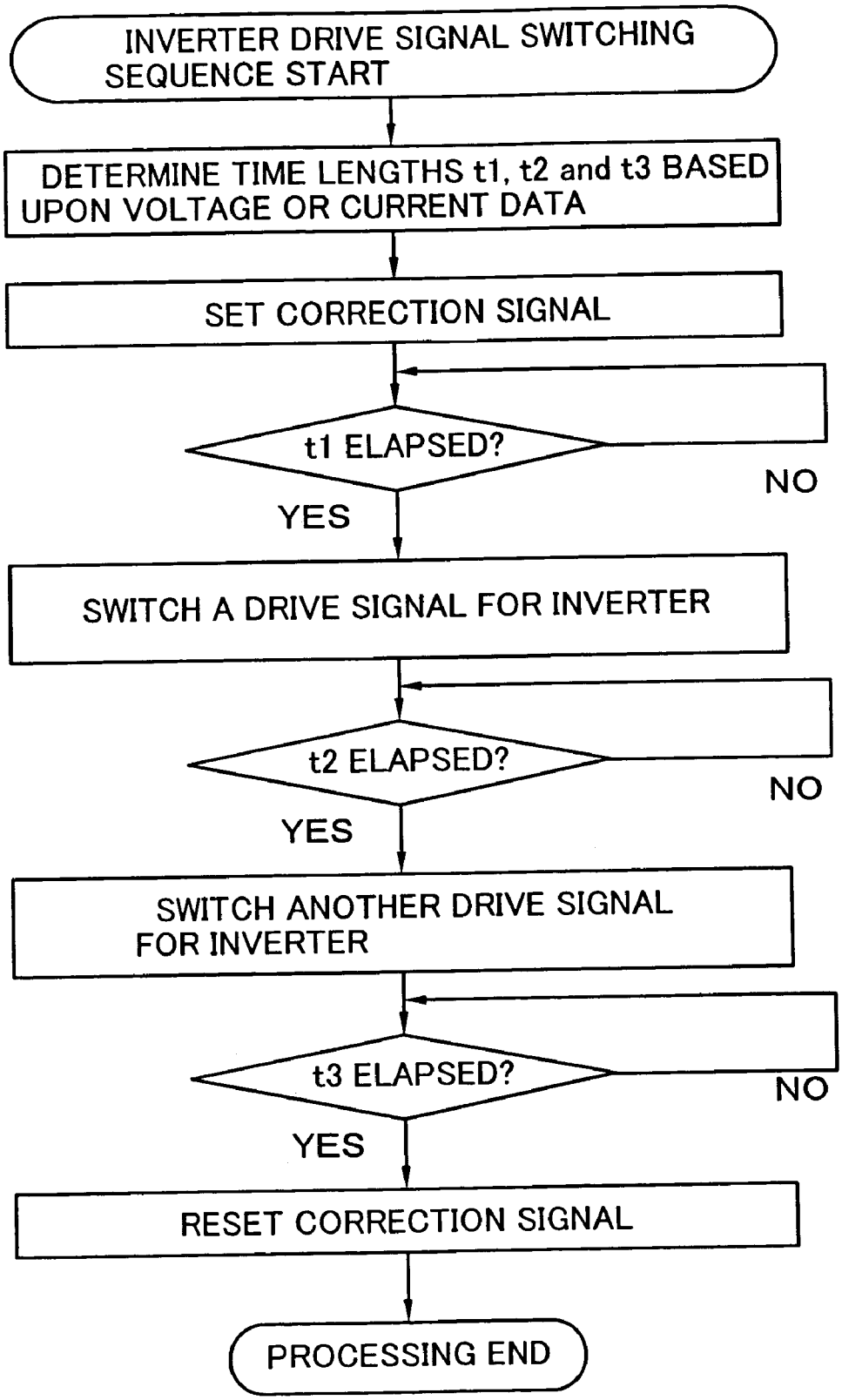
FIG. 4 presents a flowchart of the second control mode achieved in the embodiment shown in FIG. 1.
Figure 5:
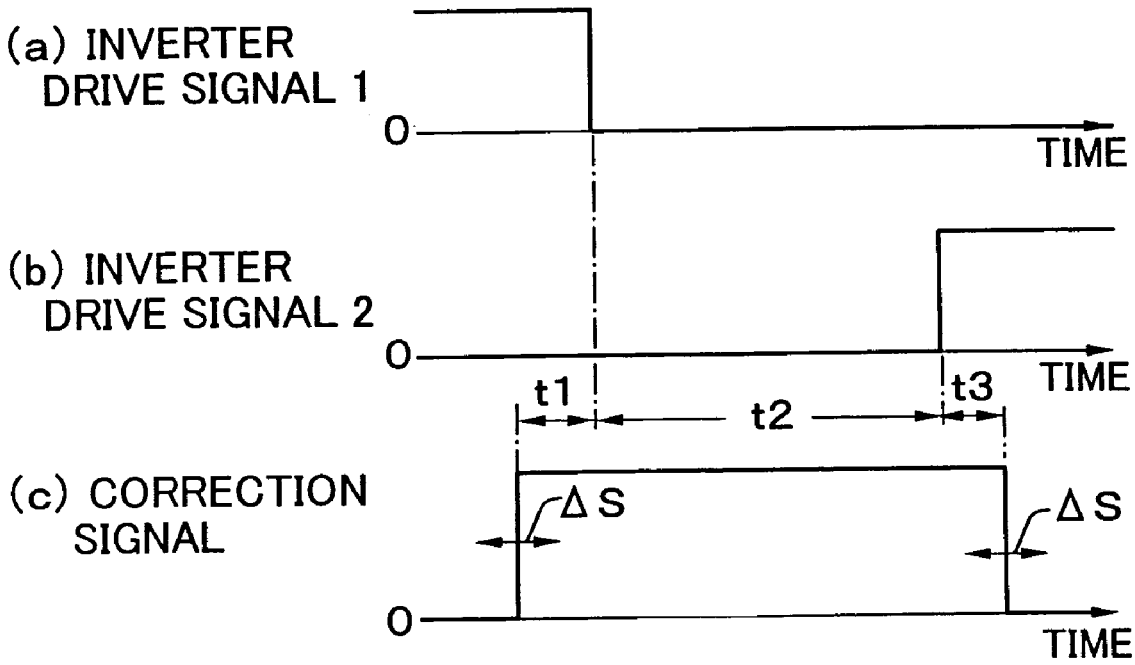
FIG. 5 is a timing chart of the second control mode achieved in the embodiment shown in FIG. 1.

FIG. 4 presents a flowchart of a second control mode achieved in the embodiment of the discharge lamp lighting apparatus according to the present invention shown in FIG. 1, and FIG. 5 is a timing chart of the second control mode. In FIG. 5, t1, t2, t3 respectively represent the period of time during which the correction signal is generated prior to the dead time of the switch elements constituting the inverter 12, the dead time, and the period of time during which the correction signal is generated following the dead time, and an arrow ΔS represents the extent to which the correction signal S2 can be varied.

In this mode, control is implemented by varying the length of time over which the correction signal is generated as indicated by the arrow ΔS in FIG. 5. The sequence starts, then the period t1, the dead time t2 and the period t3, over which the correction signal S2 is generated, are determined based upon the power detection signal S(IV) provided by the power calculation unit 20 and the correction signal is set accordingly.

Next, when the correction signal generation period t1 prior to the dead time elapses, the drive signal 1 for the inverter 12 is switched and, in response, the inverter 12 enters the dead time period t2. While the length of the dead time t2 may be a predetermined specific length, the length of dead time t2 is determined based upon the power detection signal S(IV) provided by the power calculation unit 20 in this control mode.

When the dead time t2 elapses, the drive signal 2 for the inverter 12 is switched, thereby inverting the polarity of the AC rectangular wave output by the inverter 12. Subsequently, the correction signal generation period t3 after the dead time elapses, then the correction signal S2 is reset and the sequence of the processing ends.

During this sequence, the correction signal generation unit 25 provides the correction signal S2 to the converter control signal generation unit 21 so as to reduce the output power command value S1. As a result, the extent of overshoot and vibration in the voltage/current are reduced when the polarity of the AC rectangular wave voltage/current is inverted. In addition, since the length of time over which the correction signal S2 is generated is controlled in conformance to the power detection signal S(IV), the extent to which the overshoot and vibration is suppressed are controlled in a desirable manner.

While an explanation is given above on the first control mode in which the level of the correction signal S2 is controlled and the second control mode in which the length of time over which the correction signal S2 is generated is controlled, even more advanced control is enabled by combining these control modes.

Figure 6:
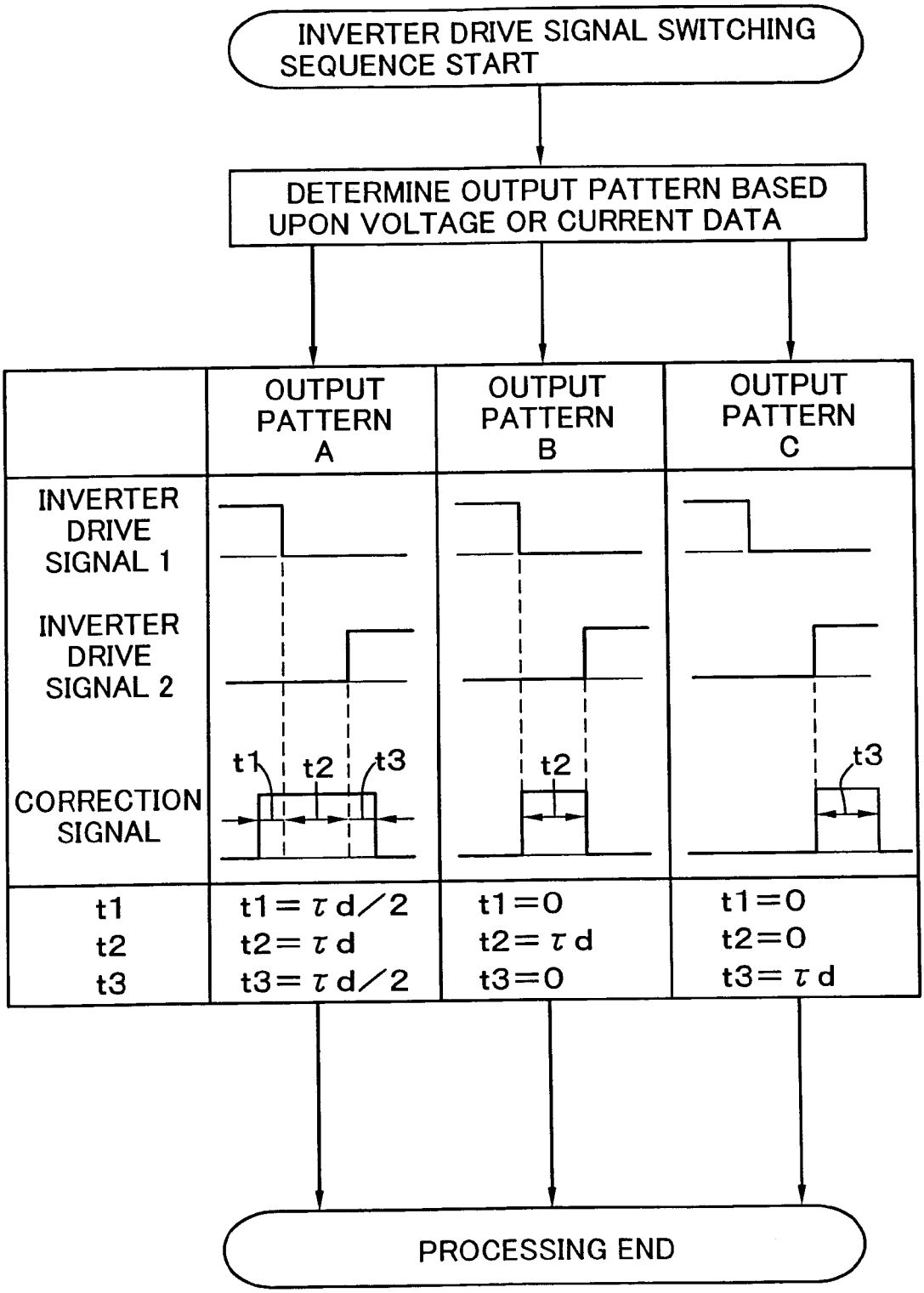
FIG. 6 presents a flowchart of the third control mode achieved in the embodiment shown in FIG. 1.

FIG. 6 presents a flowchart of a third control mode achieved in the discharge lamp lighting apparatus shown in FIG. 1. An output pattern A, an output pattern B and an output pattern C in the figure each constitute a timing chart indicating the relationship between the inverter drive signals and a specific correction signal pattern, which is stored in memory of the microcomputer 4.

In this control mode, a single correction signal pattern is selected from a plurality of correction signal patterns stored in memory of the microcomputer 4 in correspondence to the power detection signal S(IV), and the selected correction signal pattern is output to be used for control. Instead of providing a plurality of correction signal patterns in conformance to the range of power supplied to the discharge lamp, a plurality of correction signal patterns may be provided in conformance to discharge lamp characteristics, or changes in the characteristics resulting from the accumulated length of time over which the discharge lamp has been lit.

The sequence of the control mode starts, then a correction signal pattern to be output, i.e., one of the output pattern A, the output pattern B and the output pattern C, is selected and set. The correction signal pattern is output with predetermined timing together with the drive signals for the inverter 12, and the processing ends.

Now, the output patterns shown in the figure are explained. The output pattern A, which includes correction signal generation periods t1 and t3 both extending over a time period (td/2) and a correction signal generation period t2 extending over a time period td, is selected when the level of the power supplied to the discharge lamp is relatively high.

In the output pattern B, the correction signal is only generated during the period t2 extending over the time period td.

The output pattern C, which includes a single correction signal generation period t3 extending over td/2 following the period t2, is selected when the level of the power supplied to the discharge lamp is relatively low.

While correction signal patterns achieved by varying the correction signal generation period alone are described above, correction signal patterns achieved by varying the correction level or corrections signal patterns achieved by a combination of the varying correction signal generation periods and the varying correction signal level may be adopted instead. Thus, it is possible to set an unlimited number of correction signal patterns including a pattern in which no correction signal is generated.

Figure 7:
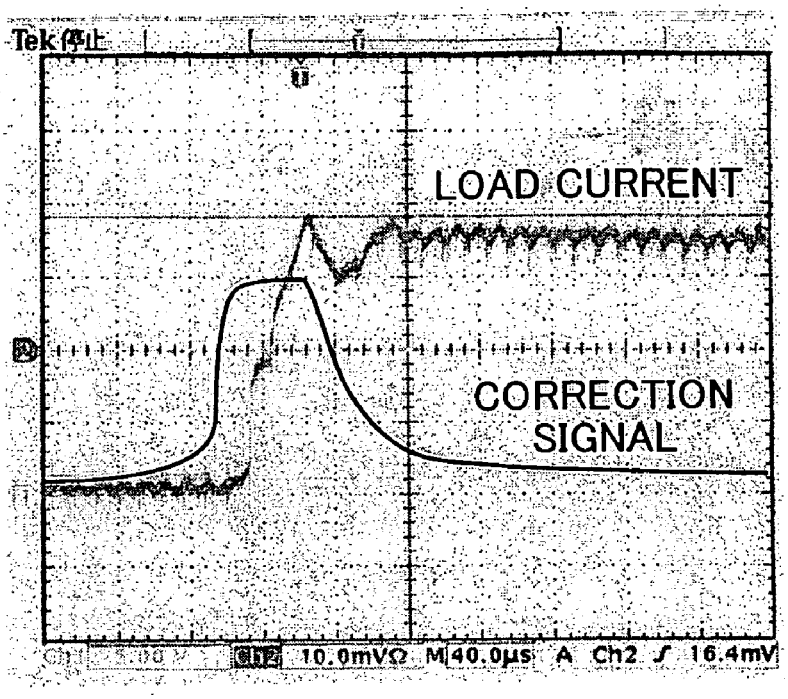
FIG. 7 shows the waveforms of a correction signal and the load current achieved under the second control mode in the discharge lamp lighting apparatus shown in FIG. 1.
Figure 8:
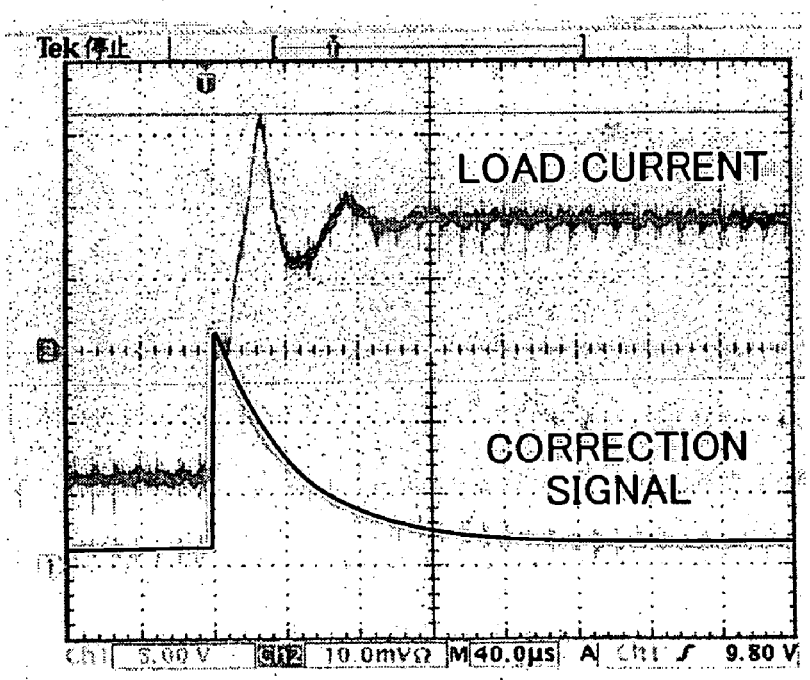
FIG. 8 shows the waveforms of a correction signal and the load current achieved under the correction signal with a constant correction quantity unlike the correction signal in the present invention, presented for comparison with FIG. 7.
Figure 9:
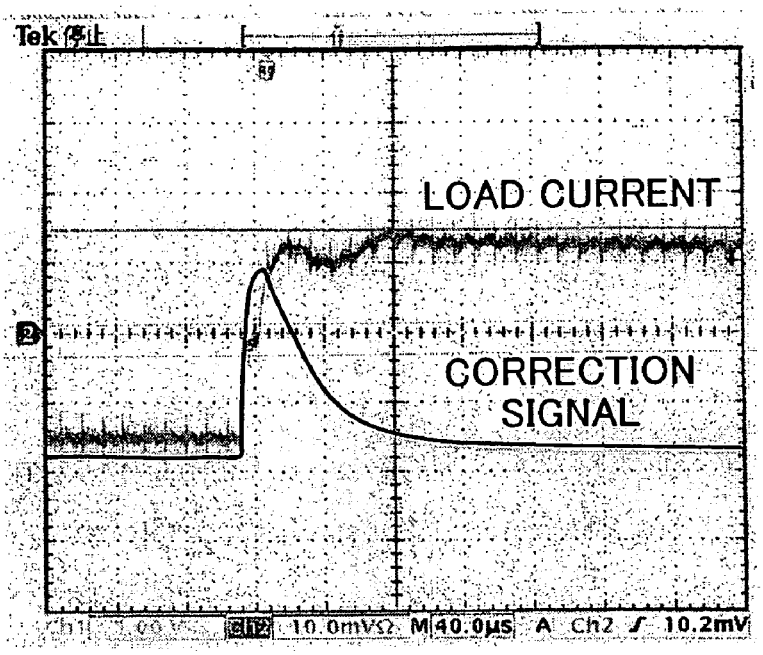
FIG. 9 shows the waveforms of a correction signal and the load current achieved under the second control mode in the discharge lamp lighting apparatus shown in FIG. 1.
Figure 10:
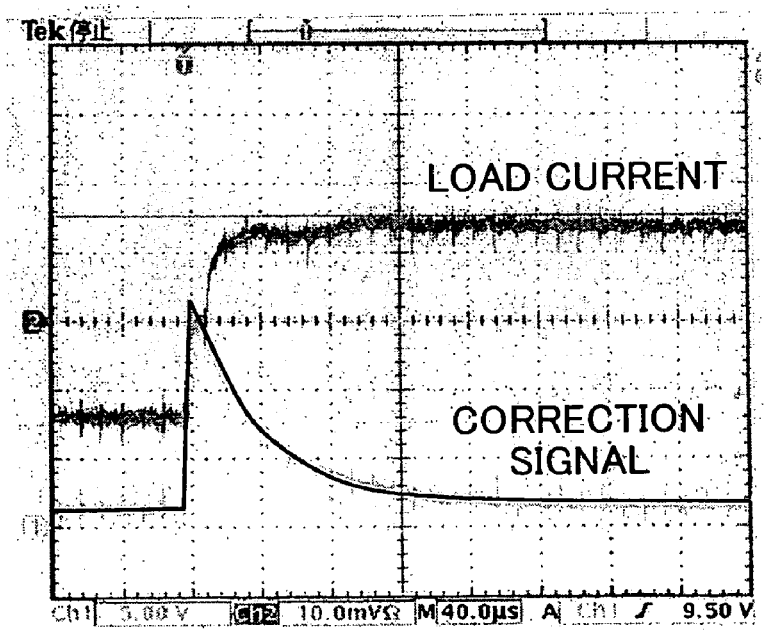
FIG. 10 shows the waveforms of a correction signal and the load current achieved under the correction signal with a constant correction quantity unlike the correction signal in the present invention, presented for comparison with FIG. 9.
Figure 11:
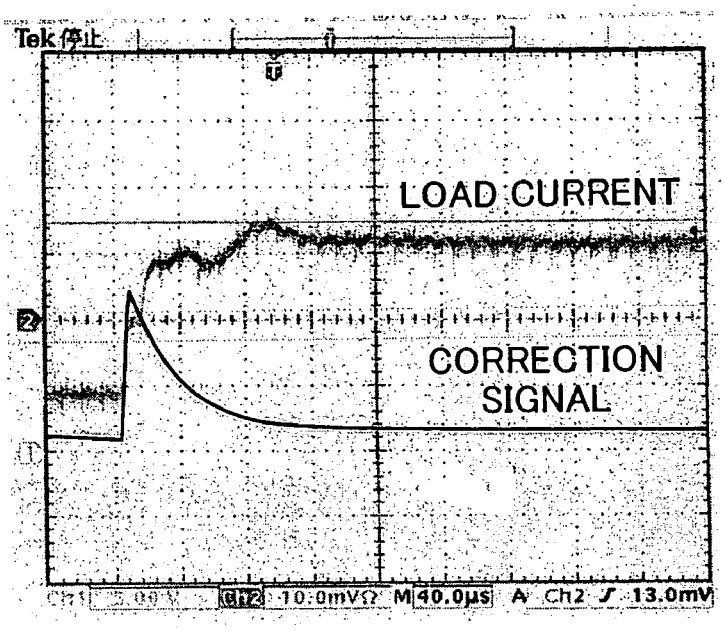
FIG. 11 shows the waveforms of a correction signal and the load current achieved under the second control mode in the discharge lamp lighting apparatus shown in FIG. 1.
Figure 12:
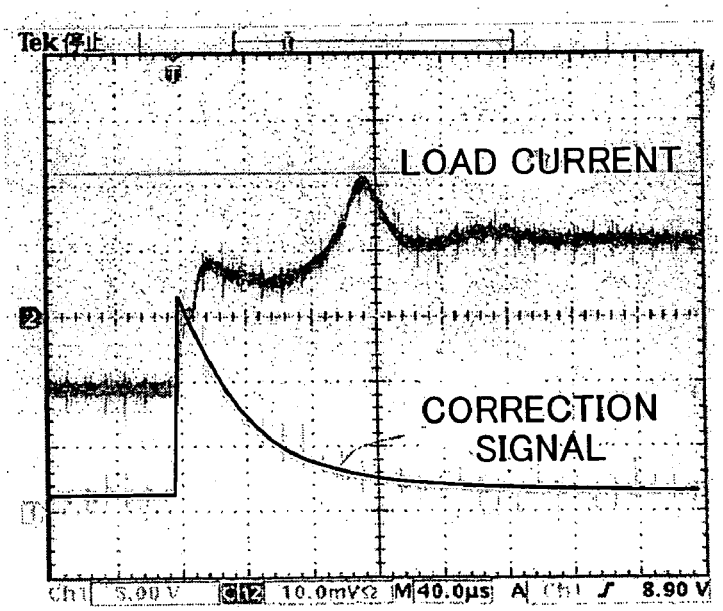
FIG. 12 shows the waveforms of a correction signal and the load current achieved under the correction signal with a constant correction quantity unlike the correction signal in the present invention, presented for comparison with FIG. 11.
Figure 13:
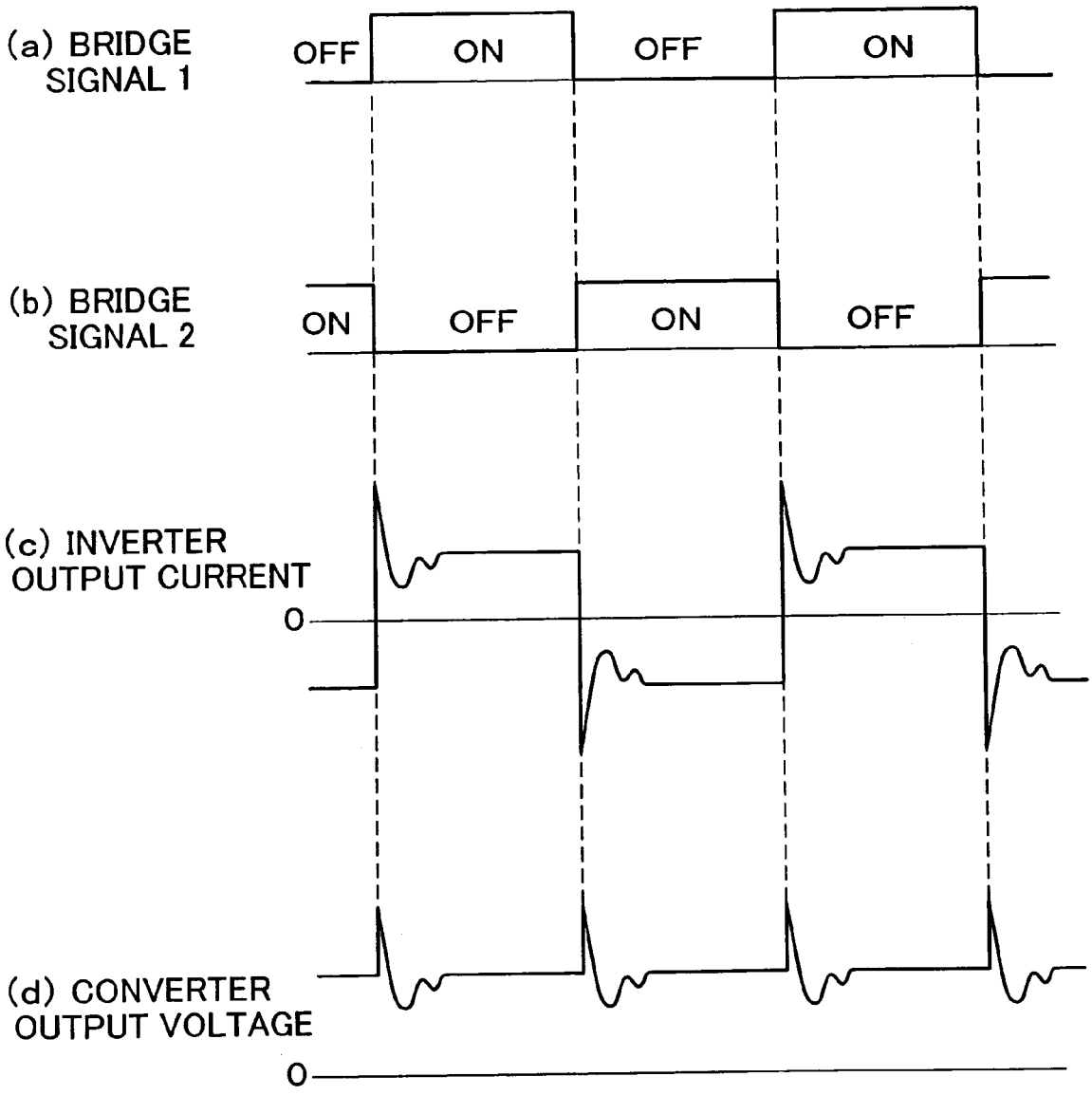
FIG. 13 is a waveform diagram showing the waveforms detected at various components of a discharge lamp lighting apparatus which lights a discharge lamp with AC rectangular wave power.
Figure 14:
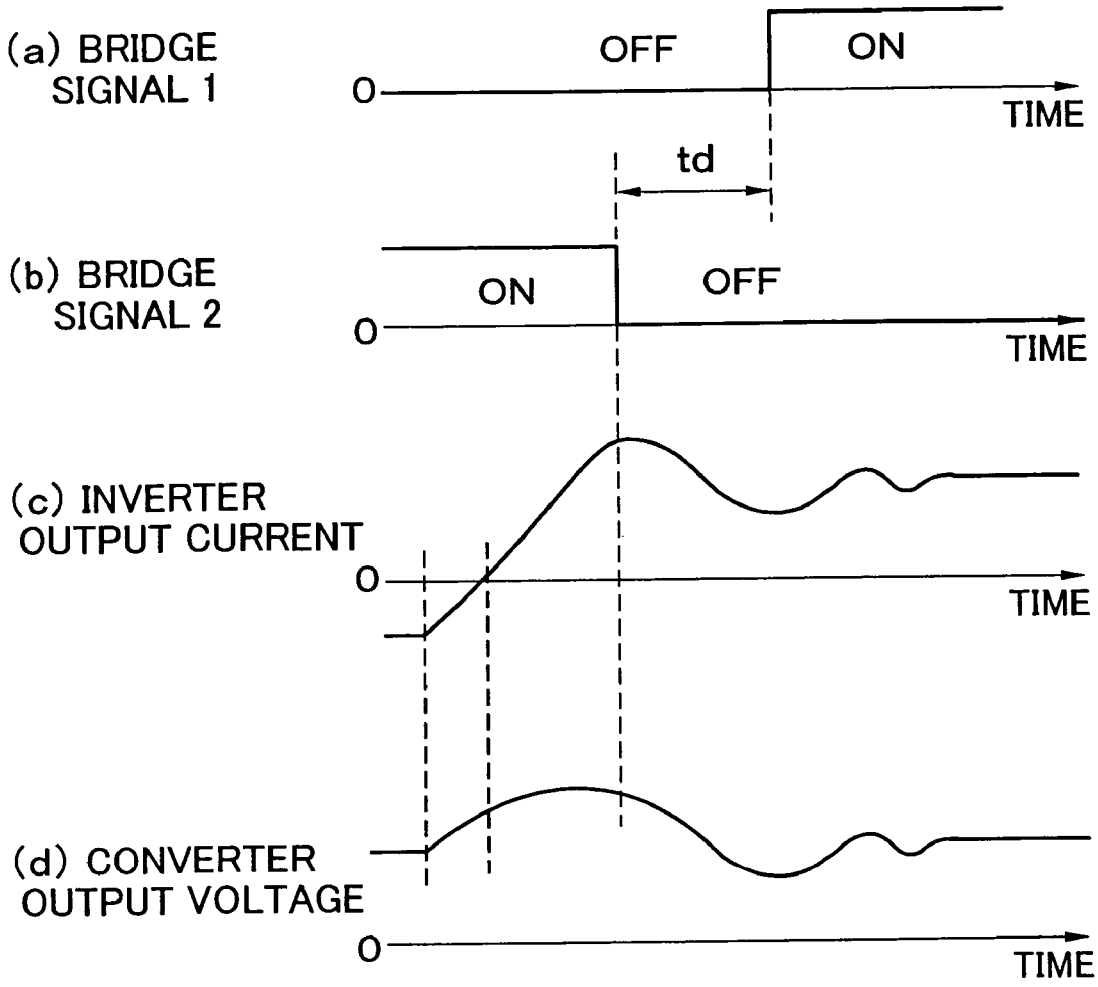
FIG. 14 presents a partial enlargement of the waveform diagram shown in FIG. 13.

FIGS. 7, 9 and 11 present waveform diagrams of the correction signal and the load current resulting from the second control mode in the discharge lamp lighting apparatus according to the present invention shown in FIG. 1, whereas FIGS. 8, 10 and 12 present waveform diagrams of a correction signal and the load current resulting from a correction signal with a constant correction quantity unlike the correction signal in the present invention, provided for purposes of comparison.

FIGS. 7 and 8 show waveforms achieved by lighting the discharge lamp with the discharge lamp allowable load current set to the maximum value. The waveforms in FIG. 7 resulting from the second control mode of the present invention indicate that the correction signal is generated over a longer period of time and that a desirable reduction of the overshoot of 114% is achieved. The waveforms in FIG. 8 resulting from the correction signal with a constant correction quantity unlike the correction signal in the present invention indicate that the load current is corrected to a lesser extent with a considerable overshoot of 184%.

FIGS. 9 and 10 show waveforms achieved by lighting the discharge lamp with the discharge lamp allowable load current set to an intermediate value. The correction signal is generated over lengths of time substantially equal to each other in FIGS. 9 and 10, and the extent of overshoot is reduced in a desirable manner in both cases to 114% in FIG. 9 and 115% in FIG. 10.

FIGS. 11 and 12 show waveforms achieved by lighting the discharge lamp with the discharge lamp allowable load current set to the minimum value. The waveforms in FIG. 11 resulting from the second control mode of the present invention indicate that the correction signal is generated over a shorter period of time and that a desirable reduction of the overshoot of 132% is achieved. The waveforms in FIG. 12 resulting from the correction signal with a constant correction quantity unlike the correction signal in the present invention indicate that the load current is corrected to a greater extent and a distortion in the waveform occurs with a considerable overshoot of 195%.

As explained above, while the overshoot can be suppressed over a wide range of the allowable discharge lamp load current by implementing control in the control mode of the present invention, the overshoot cannot be successfully suppressed outside a specific limited load current range if control is implemented by using a correction signal with a constant correction quantity unlike the correction signal in the present invention.

While the invention has been particularly shown and described with respect to a preferred embodiment thereof by referring to the attached drawings, the present invention is not limited to this example and it will be understood by those skilled in the art that various changes in form and detail may be made therein without departing from the spirit, scope and teaching of the invention.

What is claimed is:

1. A discharge lamp lighting apparatus comprising:

a converter that switches power input thereto, converts the switching output to DC power and outputs the DC power;

an inverter that converts the DC power supplied from the converter to AC rectangular wave power and outputs the AC rectangular wave power; and a controller that comprises:

first means for generating a power detection signal by calculating power based upon a voltage detection signal and a current detection signal detected on the output side of the converter;

second means for outputting an output power command value to be used to control the DC power so as to achieve a target value;

third means for generating a correction signal to be used to correct the output power command value in conformance to the power detection signal and outputting the correction signal in synchronization with a polarity inversion of the AC rectangular wave power;

fourth means for receiving the output power command value, the correction signal and the power detection signal and outputting a signal corresponding to the error of the power detection signal relative to the output power command value having been corrected by the correction signal; and fifth means for implementing pulse width control on the converter based upon the signal provided by the fourth means.

2. The discharge lamp lighting apparatus of claim 1, wherein:

the second means sets the current value of the DC power as a target value and controls the current.

3. The discharge lamp lighting apparatus of claim 1, wherein:

at least the first means and the third means in the controller are constituted with a microcomputer.

4. The discharge lamp lighting apparatus of claim 3, wherein:

the third means controls the level of the correction signal in conformance to the power detection signal.

5. The discharge lamp lighting apparatus of claim 3, wherein:

the third means controls the length of time over which the correction signal is generated in conformance to the power detection signal.

6. The discharge lamp lighting apparatus of claim 3, wherein:

the microcomputer includes means for storing a plurality of correction signal patterns; and the third means selects a correction signal pattern among the correction signal patterns in conformance to the power detection signal and outputs the selected correction signal pattern.

7. A discharge lamp lighting apparatus comprising:

a converter that switches power input thereto, converts the switching output to DC power and outputs the DC power;

an inverter that converts the DC power supplied from the converter to AC rectangular wave power and outputs the AC rectangular wave power; and a controller that comprises:

a power calculation unit that generates a power detection signal by calculating power based upon a voltage detection signal and a current detection signal detected on the output side of the converter;

a control target value setting unit that outputs an output power command value to be used to control the DC power so as to achieve a target value;

a correction signal generation unit that generates a correction signal to be used to correct the output power command value in conformance to the power detection signal and outputs the correction signal in synchronization with a polarity inversion of the AC rectangular wave power;

a converter control signal generation unit that receives the output power command value, the correction signal and the power detection signal and outputs a signal corresponding to the error of the power detection signal relative to the output power command value having been corrected by the correction signal; and a pulse width control unit that implements pulse width control on the converter based upon the signal provided by the converter control signal generation unit.

8. The discharge lamp lighting apparatus of claim 7, wherein:

the control target value setting unit sets the current value of the DC power as a target value and controls the current.

9. The discharge lamp lighting apparatus of claim 7, wherein:

at least the power calculation unit and the correction signal generation unit in the controller are constituted with a microcomputer.

10. The discharge lamp lighting apparatus of claim 9, wherein:

the correction signal generation unit controls the level of the correction signal in conformance to the power detection signal.

11. The discharge lamp lighting apparatus of claim 9, wherein:

the correction signal generation unit controls the length of time over which the correction signal is generated in conformance to the power detection signal.

12. The discharge lamp lighting apparatus of claim 9, wherein:

the microcomputer includes memory in which a plurality of correction signal patterns are stored; and the correction signal generation unit selects a correction signal pattern among the correction signal patterns in conformance to the power detection signal and outputs the selected correction signal pattern.

* * * * *